United States Patent [19]

Miller et al.

[11] 3,945,869

[45] Mar. 23, 1976

[54] METHOD AND MEANS OF IMPROVING LAYDOWN AND WRITING CHARACTERISTICS OF FIBROUS POINTS AND POINTS OBTAINED THEREBY

[76] Inventors: Clinton Earl Miller, 8301 Georgetown Ave., Los Angeles, Calif. 90045; Nabil Gabriel Naggar, 751 N. Gower St., Los Angeles, Calif. 90038

[22] Filed: July 1, 1974

[21] Appl. No.: 484,943

[52] U.S. Cl. ..... 156/180; 156/305; 156/306; 156/441; 401/198

[51] Int. Cl.[2] ..... B43K 1/12; D04H 3/14

[58] Field of Search ..... 156/166, 180, 167, 441, 156/436, 161, 286, 305, 306, 307; 117/121.2; 401/198; 425/104, 505, 506, 508; 264/257, 258, 174–184

[56] References Cited

UNITED STATES PATENTS

| | | | |
|---|---|---|---|
| 3,558,392 | 1/1971 | Goodenow et al. | 156/180 |
| 3,715,254 | 2/1973 | Tolgyesi | 156/180 |
| 3,819,442 | 6/1974 | Brushenko | 156/180 |

*Primary Examiner*—Douglas J. Drummond
*Assistant Examiner*—Michael W. Ball

[57] ABSTRACT

Relates to continuous methods of making writing points from filamentary thermoplastic materials differing in denier, whereby writing characteristics are improved and the ink content of porous reservoirs is more efficiently utilized. It is particularly directed to the methods of manufacturing such writing elements from yarns differing in denier of filaments whereby the size and location of ink-conveying channels in the cross-section of the writing point or element and the writing characteristics thereof are uniformly and positively controlled and maintained by being able to place and retain a particular position for each yarn during manufacture and bonding, and to means whereby such control can be attained.

4 Claims, 6 Drawing Figures

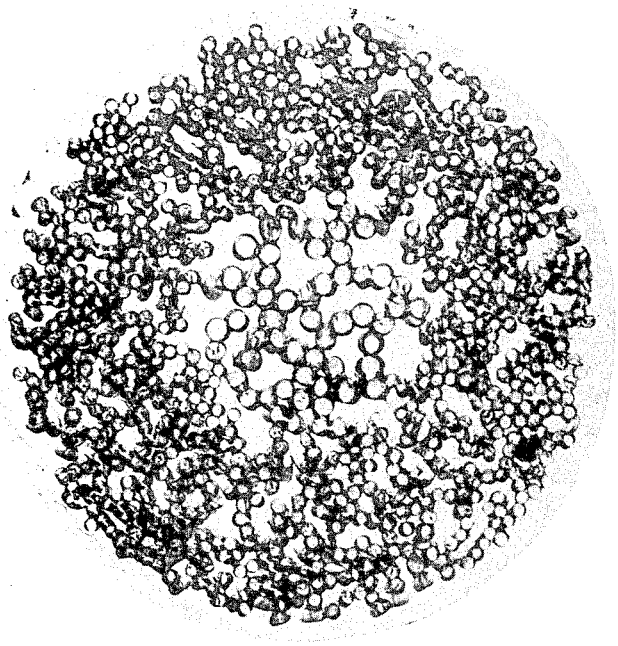
Fig. 4.
Fig. 6.
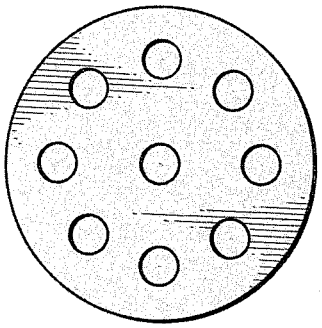
Fig. 5.
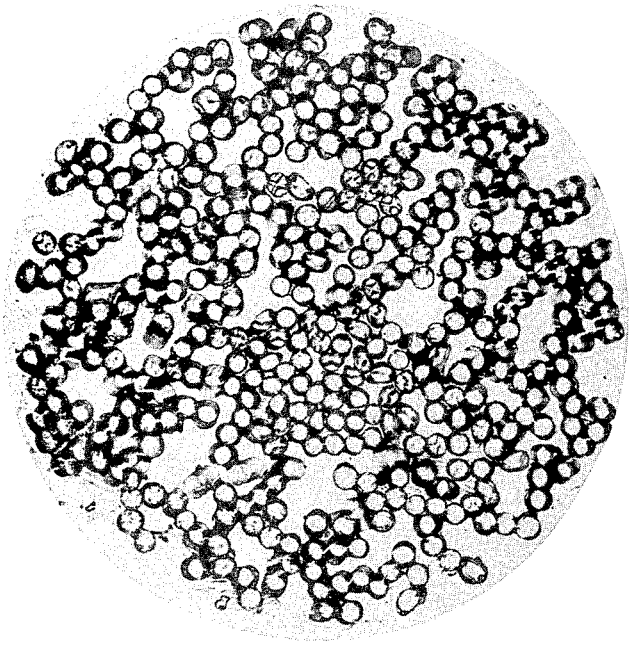

METHOD AND MEANS OF IMPROVING LAYDOWN AND WRITING CHARACTERISTICS OF FIBROUS POINTS AND POINTS OBTAINED THEREBY

Although the use of filaments and fibers in the form of brushes as a writing instrument goes back to ancient Chinese times, the modern writing instrument employing a fibrous point is manufactured in accordance with U.S. Letters Pat. Nos. 3,558,392 and 3,623,941, owned by the assignee of the present application. Writing instruments manufactured in accordance with the above patents were highly accepted by the purchasing public, but a few objections were also voiced. Some customers object to the fibrous point because, although they write smoothly, such points brush out and do not write with a fine line. Another objection which has been raised is that the fibrous point is rather scratchy and does not write smoothly and quietly. Another modern objection is that the lines are not sufficiently intense.

These various objections are interrelated: the brush-out problem can be met readily by increasing the amount of bonding agent used in the manufacture of the points, but the use of an excessive amount of bonding agent not only produces a scratchy point but also one which is incapable of feeding a proper quantity of ink to the point during fast writing. Moreover, by using a higher resin content or bonding agent content between the fibers, onee attains a fine writing instrument, when it writes, but it is incapable of writing rapidly or for a prolonged period of time. By using less bonding resin in the points, the amount of ink supplied to the point and laid down can be increased, but this gives more porous and weaker points which are able to brush out more readily. The amount of ink actually capable of being written with by a point can also be increased by using filaments of a larger diameter or higher denier, but this gives rise to increased scratchiness, reduced smoothness and points made of these larger denier filaments cannot draw as much ink out of the reservoir and refuse to write when about 37% of the original ink is still left in the porous reservoir.

The use of a bundle of wires (which may be said to be filaments of large denier) was suggested many years ago as a point for a fountain pen. Suggestions have also been advanced involving the wrapping of a few large axial filaments in many layers of paper or encasing them in stretchable tubes or metal tubes, but none of these suggestions have solved the problem in a manner which can be placed in controlled continuous and consistent production on a commercial scale.

We have ascertained that the increase in intensity of line can be obtained by increasing the laydown in terms of milligrams of ink per foot of trace. We have also ascertained and discovered that this increased laydown can be attained by the employment of filaments or yarns made of synthetic filaments differing in denier, and have discovered a manner in which these different yarns, different in denier of filaments composing the same, can be positioned with accuracy in a predetermined manner within a rod or writing element which is being made in a continuous manner, the accuracy of the method and means employed being readily checked by taking samples from the beginning and the end of a rod which may be a thousand feet long.

One of the principal objects of the invention is to disclose and provide steps and means which permit the operator to successfully produce elongated writing elements in which selected large denier yarns and other finer denier yarns are accurately and positively positioned so as to obtain large ink-conveying channels in predetermined number and desired portions of the cross-section of the element and to allocate the yarns of finer denier filament in other predetermined areas to provide capillarity and soft writing without brush-out.

Another object is to provide means and methods of operation which obviate the application of high compressive forces upon an array of virtually parallel filamentary yarns, such high compressive forces tending to shift the yarns from desired positions and compact them indiscriminately in such a manner that all of the porosities between fibers and yarns are made uniform and the larger ink-conveying channels desired to produce desired high laydown are virtually eliminated.

A still further object is to provide means and methods whereby manufacturers can use strands of filamentary yarns of such denier per filament and total selected for providing desired characteristics in a writing element, and determine with exactitude the number and position that the yarns should occupy in the final writing element, and by adhering to the teachings of this invention, be assured that the desired product will be constantly produced in a continuous manner.

These and other advantages, objectives and uses of the present invention will become apparent to those skilled in the art from the following more detailed explanation and description, and for purposes of illustration and explanation, reference will be made to the appended drawings in which:

FIG. 4 and FIG. 5 are representations of photomicrographs of transverse sections of two different and exemplary types of writing elements made by the method and means of this invention.

FIG. 6 is an end view of a modified preheating and positioning apparatus similar to that shown in FIG. 3.

As previously indicated, the efficient and commercially desirable writing element made of synthetic filamentary material must contain longitudinally extending channels differing in cross-sectional area or size. It must be strong so as to resist brushing, but such strength cannot depend upon an increase in the amount of bonding resin used, since that reduces the pore size and impairs the desired soft feeling during writing. The use of stiff rods for the axial portion of the point is not satisfactory for the same reason; it becomes a very hard, unyielding and scratchy writer. The use of fine filament yarns which are impregnated with a resin and compressed into a hard rod is quite unsatisfactory since all of the remaining pores are of substantially uniform size, inadequate to supply ink to the points during rapid or prolonged writing, and cause starvation. In the method herein disclosed, we employ at least two different types of yarn; one made of fairly large denier filaments and another composed of finer filaments, 10, 12, 15 dpf are cited as exemplary of larger size, and 3–6 dpf may be exemplary of the finer filaments. The principal problem encountered is in maintaining a predetermined spatial or polar position for each yarn during manufacture and bonding so that the size and location of the ink-conveying channels in the cross-section of the elements and the writing characteristics of the elements are constantly, consistently and positively controlled and maintained.

Figure 1:
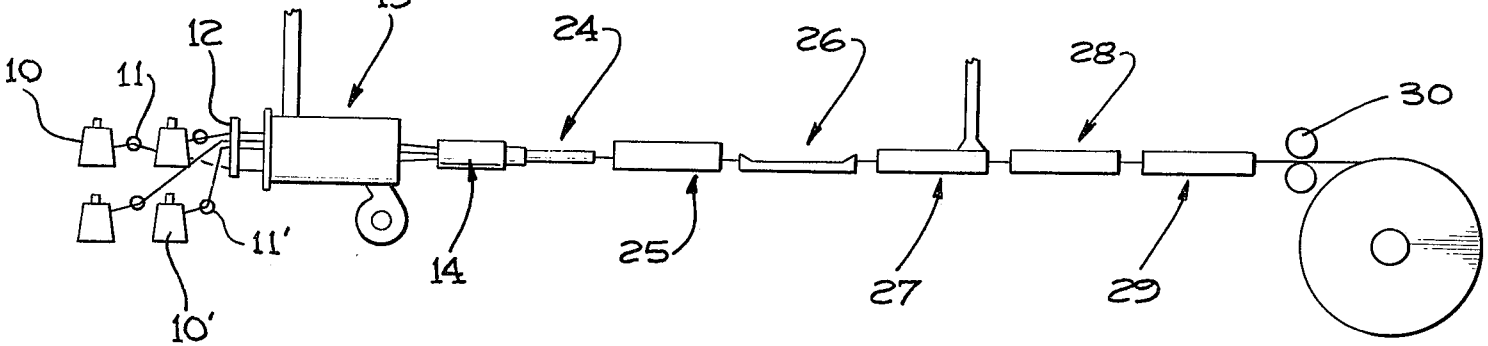
FIG. 1 is a diagramatic flow chart of a continuous operation in accordance with the description given hereinafter.

As shown in FIG. 1, yarns of two (or more) different sizes may be supplied to the production line from a plurality of sources, such as the bobbins 10 and 10', each strand of yarn from a bobbin being controlled by a tensioning device 11 through which the yarn passes before it travels through a specific hole in a perforated plate 12. The tensioning device 11 may be in the form of spring biased devices such as are used for the tensioning of thread on sewing machines. Each of the yarns is pulled through the perforated plate as hereinafter described, and then through a preheater 13, wherein the individual strands, spaced from each other, are subjected to a current of hot air at 150°–170°C flowing in a countercurrent direction, which serves to dry and heat the yarn for subsequent treatment.

Figure 2:
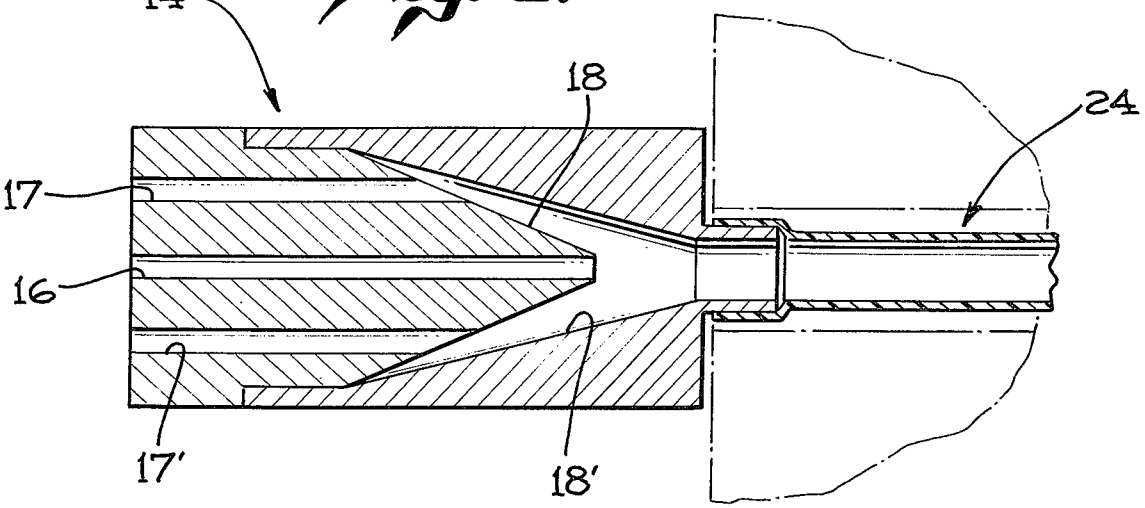
FIG. 2 is an enlarged longitudinal section through the positioning portion of the apparatus.

From the preheater 13, the various strands pass into positioner 14 which constitutes the important means for bringing the yarn strands into initial contact in the desired polar or spatial orientation without application of radial compression forces which may cause drifting out of desired position. This particular equipment 14 is illustrated in longitudinal section in FIG. 2 and in end view in FIG. 3. The unit 14 preferably provides a plurality of parallel open-ended metal-walled passageways, including axial and circumaxial passageways. As shown in FIG. 2, the body of the device 14 may comprise a metal block provided with through bores, such as 16 (representing an axial passageway), and 17, 17' and the like, in circumaxial array. A similar arrangement of passageways may comprise a series of tubes soldered, brazed or bonded together. Each passageway should be of sufficiently large diameter to permit a yarn to be easily pulled therethrough with negligible contact with the walls of the passageway. The exits of the passageways for yarns farthest removed radially from the axial yarns (such as exit of passageway 17') should be displaced longitudinally with respect to the exits of the axially positioned yarns, all said passageways exiting into a chamber having conical walls at an acute angle to the axis, these walls being indicated at 18 and 18'. The wall 18' may be a part of an outer wall member which is in poor heat conductive contact with the sintering tube 24 and also in heat conductive contact with the body of the element 14. The wall or surface 18 of the body member may be that of a cone having an included angle at its apex (projected) of about 40°–50°, whereas the enclosing outer conical wall 18' may be the surface of a cone having an apex angle of about 25°—30° and such surface is confluent with the inner surface of tube 14. It will be evident that the included angle of conical wall or surface 18 generally controls the longitudinal displacement of the exits such as 17' above referred to. And the slightly smaller outer conical wall 18' insures that the passageway exits are almost adjacent the entrance to the sintering tube. In this manner the travel of the different yarns in an unsupported condition is almost completely eliminated.

The tube 24 is provided ordinarily with some readily controllable means of heating the tube (such as hot oil or resistance heaters) to a temperature adapted to produce incipient fusion or sintering of at least some of the fibers of a yarn. In the device illustrated, there was very little heat flowing from the sintering tube to the walls of the passageways 16, 17 and the like of the orienting and positioning device. Separate means of supplying heat to the various tubes of the device 14 may be utilized.

It will be noticed that each strand of yarn as it is being pulled through the heated passageways is uncompressed and is discharged into an inclined chamber wherein the yarn is gently bent and placed into contact with the axial yarn discharging through passageway 16 in a precise angular, spatial or polar position just before entering the sintering tube 24 in which the heat is sufficient to lightly sinter the external yarn to the axial yarn or yarns. It may be noted that in starting the operation, each individual yarn is led through each desired passageway and is constantly under tension as it is pulled through the entire apparatus including the positioning and orienting unit 14 as well as the sintering tube 24. Tensions on the order of between about 6 to 10 grams per yarn have been found adequate. In making a writing element in the form of a rod 0.05 to 0.07 inches in outside diameter, from 7, 9 or 10 yarns, the array of metalwalled passageways in the preheating and conditioning unit 14 may occupy a cross-sectional area 5 to 10 times the cross-sectional area of the bonding tunnel 24. These relationships indicate the very minute and delicate bending that the individual preheated yarns are subjected to before and during the time that they are brought into actual contact and bonded together.

The temperatures in the preheater 13 and in the tubes of the positioning unit 14 may be within the range of 150°C to 180°C when the filamentary material used in the yarns is a polyamide, such as nylon. Since the individual strands of yarn are under only very slight tension, the yarn will only be slightly straightened in the event it had been bulked.

The sintering tube 24, which has been used with considerable success, consists of a stainless steel tube provided with an interior lining of "Teflon" (polytetrafluoroethylene). The "Teflon" liner tube is in thermal contact with the unit 14, as previously stated, and the oil is heated to approximately 217°—218°C, which is approximately within the melting range of the polyamide used in the filaments. Signs of incipient fusion at random spots are shown by examination of the treated yarns and their photomicrographs. The slight sintering takes place between yarns while they are moving in the absence of any added bonding agent.

From the bonding or sintering operation in the tunnel 24, the now coherent element is drawn into the cooling zone 25 and then through an impregnating tube bath 26, where it may be impregnated with a bonding agent in solution in a suitable volatile vehicle. Reference is here made to U.S. Pat. No. 3,558,392 for a more detailed description of bonding agents and volatile solvents which may be employed. After impregnation, the rod is consecutively passed through the evaporator 27 and a curing oven 28, then cooled and discharged by a puller 30 onto a cutting table or wound upon large reels for transfer to a cutting and grinding operation to contour the ends for writing purposes before installing the elements in a pen body.

Figure 3:
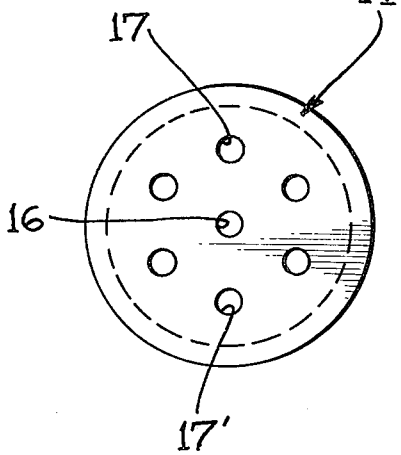
FIG. 3 is an end view taken from the left of FIG. 2.

FIG. 4 is a photomicrograph of a cross-section taken through a writing and ink-feeding element made by employing an arrangement of passageways in a positioning unit 14 as shown in FIGS. 2 and 3 and by pulling a single strand of 840/56 nylon (15 dpf) through the axial passageway 16 and a single strand of 840/136 (6 dpf) through each of the circumaxial passageways 17, 17' and the like. FIG. 4 clearly shows that the larger ink-conducting channels have been located in the central area of the rod which constitutes the writing point of the element and of the finer filament yarns surround the central yarn and impart softness as well as strength to the point. The method here disclosed does not rely greatly, if at all, upon compaction of adjacent strands in the sintering tube. It may be noted that the point of FIG. 4 measured 0.05354 inch in O.D. while the I.D. of tube 24 was 0.05556 inch.

FIG. 5 illustrates the effect of using 7 strands of 840/56 (15 dpf) yarn in the same equipment and process. This point had a higher initial laydown, but did not write well. The following tabulation reports the results of a test of points made of 7 strands of 840/56 (as in FIG. 5), 7 strands of 840/136 (not illustrated) and of 6 circumaxial 840/136 and 1 axial 840/56 shown in FIG. 5. All points were made at same speed and temperatures, impregnated with same bonding solution and tested in standard barrels charged with equal amounts of same ink.

| POINT COMPOSITION | LAYDOWN Mg/ft. INITIAL | - 1200′ | % INK USED | POINT STRENGTH | INITIAL *SMOOTHNESS | *GEN PERF |
|---|---|---|---|---|---|---|
| FIG 5 — 7 Strands 840/56 | 0.64 | 0.53 | 63 | 30 | 3.4 | 3.6 |
| 7 Strands 840/136 | 0.48 | 0.51 | 65 | 30 | 3.6 | 3.4 |
| FIG 4 — 6 Strands 840/136 1 Strand 840/56 | 0.66 | 0.60 | 78 | 33 | 4.0 | 3.8 |

Explanatory: 20 pens of each group submitted to 20 testers. Each tester evaluated each pen for smoothness and general performance on an arbitrary scale of 5 very good, 3 satisfactory and 1 poor. The first evaluation was after the tester wrote his name and Johnson. The pen was then used in writing 200 ft. under a 50 gram load and another 800 ft. under a 130 gram load and again evaluated by the tester. Point strength is line width in mils after writing 16′ under a 300 gram load.

Attention is drawn to the uniformly higher laydown of FIG. 4 (mixed yarn) points and their higher smoothness and general performance ratings. A study of such results shows that writing elements of any desired type can now be manufactured in a predetermined and constant manner.

From the examples given, it is quite evident that a great variety of mixed yarns in various proportions may be utilized in a positive controlled manner in the manufacture of points having specific characteristics.

FIG. 6 illustrates a modified array of passageways involving 8 circumaxial passageways surrounding the axial passageway. It may be mentioned that placement of circumaxial passageways at an equal distance from the axial passageway appears to produce more dependable results. It is also believed that the use of yarns differing in dpf but containing virtually equal amounts of the thermoplastic synthetic polymer being used, facilitates the orderly and positive positioning of the strands in the final product; a virtually identical tension is effectively used on all strands and heat absorption characteristics are equalized. Although particular reference has been made herein to elements composed of filaments of 15 and 6 denier, such filaments have been used in various arrangements and quantities only for the purpose of testing and comparison and that the invention is not limited thereto.

We claim:

1. In a method continually producing elongated elements adapted for use in writing instruments, said elements being composed of a plurality of parallel strands of yarns differing in denier per filament, bonded into a porous but strong element, the steps of:

maintaining a predetermined polar position for each yarn during manufacture and bonding, whereby the size and location of ink-conveying channels in the cross-section of the elements and the writing characteristics thereof are uniformly and positively controlled and maintained, including:

preheating the strands while out of contact with each other to a temperature of between about 110°C and 125°C without sintering or incipient fusion, and providing a plurality of parallel open-ended, metal-walled passageways including axial and circumaxial passageways, each passageway being adapted to receive and permit a strand to be easily pulled therethrough with negligible contact with the walls:

discharging the preheated sorted individual strands onto a first conical surface surrounded by a conical heated enclosing surface spaced from the first, said enclosing surface leading to an entrance to an adjacent sintering tube coaxially aligned with and forwardly positioned with respect to the conical surfaces;

said conical surfaces bringing the various preheated and axially moving strands into initial contact in relative polar positions established substantially at the entrance to said sintering tube by the array of pathways and then drawing the contacting and positioned strands through the sintering tube to lightly sinter the moving yarns in said established polar position.

2. A method as stated in claim 1, wherein the strands are composed of filamentary thermoplastic polymer yarn and are of virtually equal total denier.

3. A method as stated in claim 1, wherein more than one strand of yarn is pulled through the axial passageway, the circumaxial passageways are equally spaced from the axial passageway and a single yarn is pulled through each of the circumaxial passageways.

4. A method as stated in claim 1, followed by the step of cooling the lightly sintered yarns, impregnating the same with a bonding agent in a volatile solvent, and curing the bonding agent.

* * * * *

UNITED STATES PATENT OFFICE

CERTIFICATE OF CORRECTION

Patent No 3,945,869 Dated March 23, 1976

Inventor(s) Clinton E. Miller and Nobil G. Naggar

It is certified that error appears in the above-identified patent and that said Letters Patent are hereby corrected as shown below:

After the Inventor, the Assignee should be identified:

Assignee: The Gillette Company
Santa Monica, California

Col. 1, line 30, change "onee" to - - one - -.

Signed and Sealed this

Twentieth Day of July 1976

[SEAL]

*Attest:*

RUTH C. MASON
*Attesting Officer*

C. MARSHALL DANN
*Commissioner of Patents and Trademarks*